US011666870B2

(12) United States Patent
Larsen et al.

(10) Patent No.: US 11,666,870 B2
(45) Date of Patent: Jun. 6, 2023

(54) VENTURI MIXER WITH ADJUSTABLE FLOW RESTRICTOR

(71) Applicant: Tetra Laval Holdings & Finance S.A., Pully (CH)

(72) Inventors: Frederik Larsen, Dronninglund (DK); Hans Henrik Mortensen, Noerresundby (DK); Palle Bach Jensen, Kongerslev (DK)

(73) Assignee: Tetra Laval Holdings & Finance S.A., Pully (CH)

( * ) Notice: Subject to any disclaimer, the term of this patent is extended or adjusted under 35 U.S.C. 154(b) by 722 days.

(21) Appl. No.: 16/625,933

(22) PCT Filed: May 25, 2018

(86) PCT No.: PCT/EP2018/063845
§ 371 (c)(1),
(2) Date: Dec. 23, 2019

(87) PCT Pub. No.: WO2019/001860
PCT Pub. Date: Jan. 3, 2019

(65) Prior Publication Data

US 2020/0156021 A1 May 21, 2020

(30) Foreign Application Priority Data

Jun. 29, 2017 (EP) ..... 17178857

(51) Int. Cl.
*B01F 25/00* (2022.01)
*B01F 25/312* (2022.01)
(Continued)

(52) U.S. Cl.
CPC ..... *B01F 25/31242* (2022.01); *B01F 23/50* (2022.01); *B01F 35/1452* (2022.01);
(Continued)

(58) Field of Classification Search
CPC ..... B01F 25/31242; B01F 25/412521; B01F 23/50; B01F 35/2211; B01F 35/1452; B01F 23/56; B01F 2035/351
See application file for complete search history.

(56) References Cited

U.S. PATENT DOCUMENTS 5,779,355 A 7/1998 Pullman
8,496,189 B2 7/2013 Lomond
(Continued)

FOREIGN PATENT DOCUMENTS

WO 2017/050639 A1 3/2017

OTHER PUBLICATIONS

International Search Report for corresponding Application No. PCT/EP2018/063845, dated Jul. 27, 2018.
(Continued)

*Primary Examiner* — Anshu Bhatia
(74) *Attorney, Agent, or Firm* — Renner, Otto, Boisselle & Sklar, LLP

(57) ABSTRACT

An apparatus for mixing a liquid and a substance, including a housing with a liquid inlet and a substance inlet to a mixing chamber, an outlet for a mixture of liquid and substance, and a flow restrictor arranged in the housing, between the liquid inlet and the mixing chamber. The flow restrictor is controllable to switch between a first position providing a first through flow area configured to create a Venturi effect such that a flow of the liquid draws the substance into the mixing chamber, and a second position providing a second through flow area that is larger than the first through flow area to thereby decrease a pressure drop caused by the flow restrictor.

13 Claims, 3 Drawing Sheets

(51) Int. Cl.

| | |
|---|---|
| ***B01F 23/50*** | (2022.01) |
| ***B01F 35/10*** | (2022.01) |
| ***B01F 35/221*** | (2022.01) |
| *B01F 35/30* | (2022.01) |

(52) U.S. Cl.
CPC ..... *B01F 35/2211* (2022.01); *B01F 23/56* (2022.01); *B01F 25/312521* (2022.01); *B01F 2035/351* (2022.01)

(56) References Cited

U.S. PATENT DOCUMENTS

| | | | | |
|---|---|---|---|---|
| 2001/0024401 | A1 | 9/2001 | Short | |
| 2004/0129301 | A1 | 7/2004 | Chiang | |
| 2007/0084488 | A1* | 4/2007 | Chiang | B01F 25/31242 134/169 R |

OTHER PUBLICATIONS

Extended European Search Report for corresponding Application No. 17178857.3, dated Jan. 5, 2018.

* cited by examiner

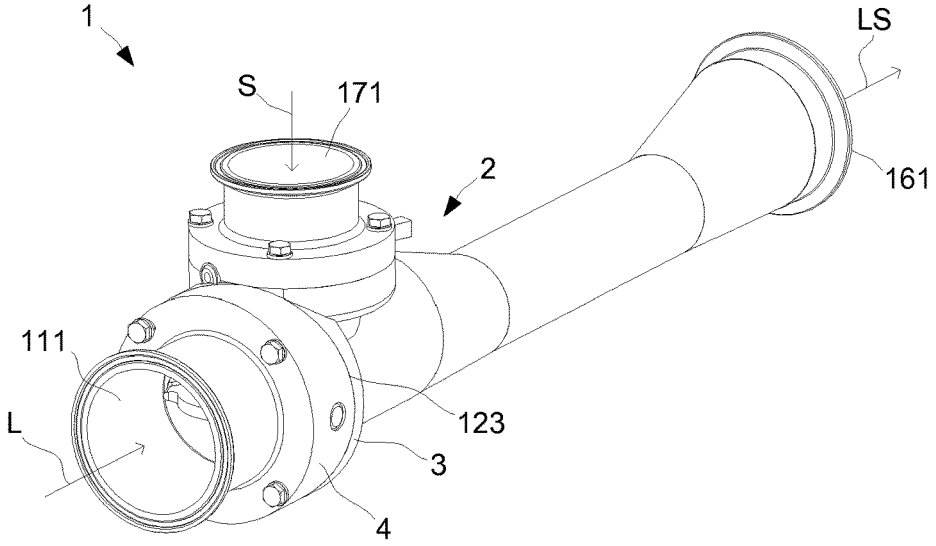
Fig. 1 (P2)
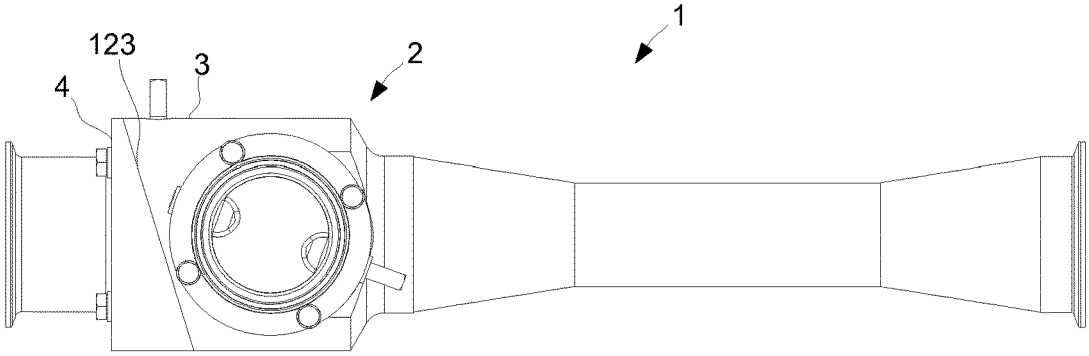
Fig. 2 (P2)
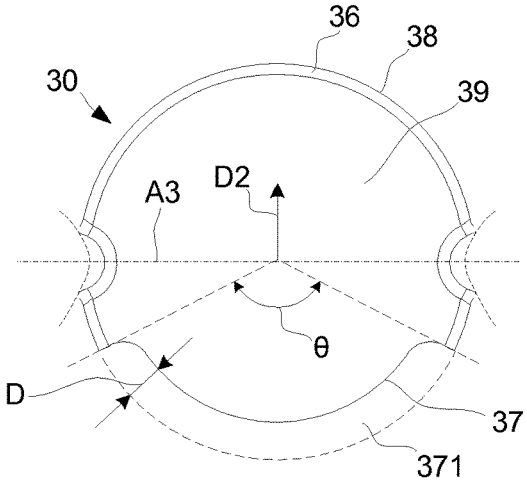
Fig. 3
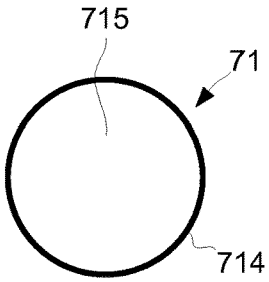
Fig. 12
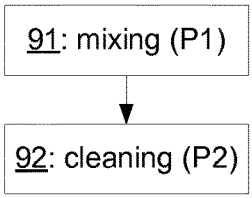
Fig. 13

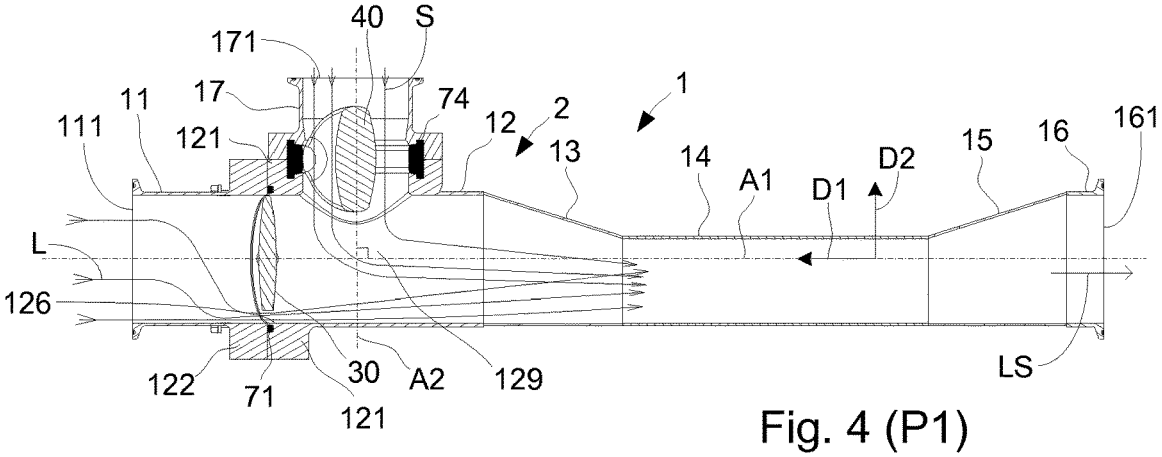
Fig. 4 (P1)
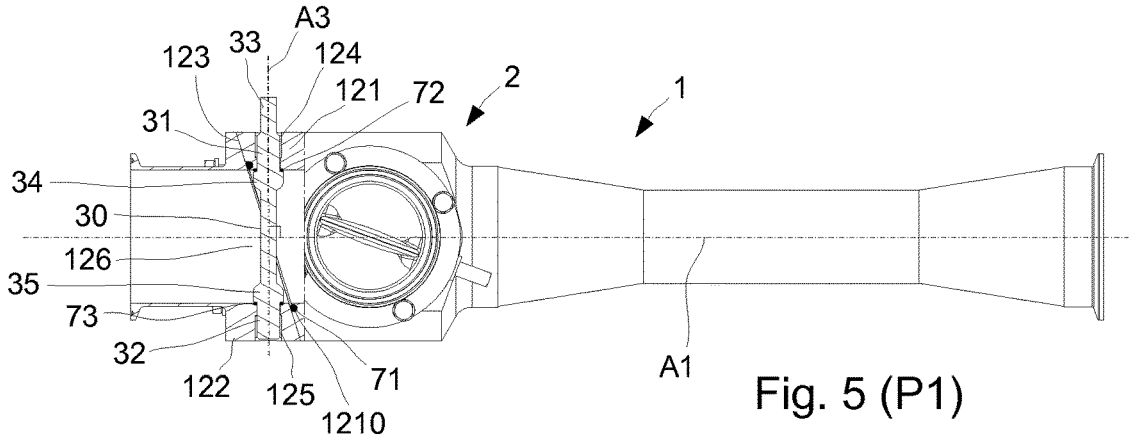
Fig. 5 (P1)
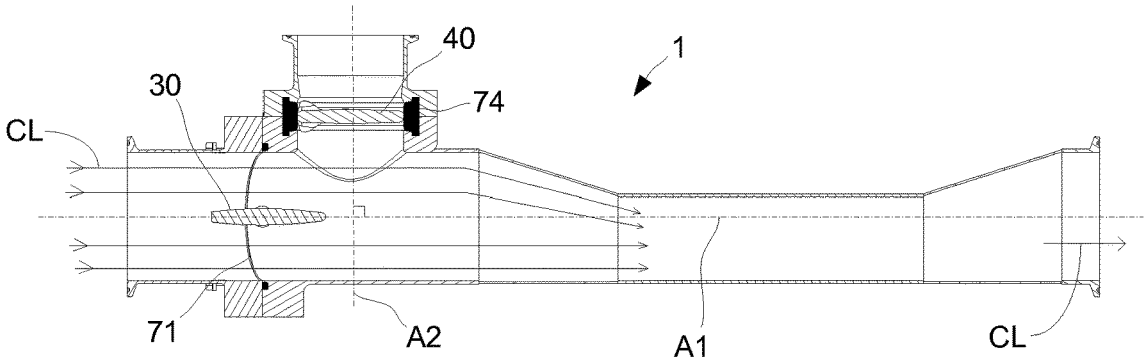
Fig. 6 (P2)
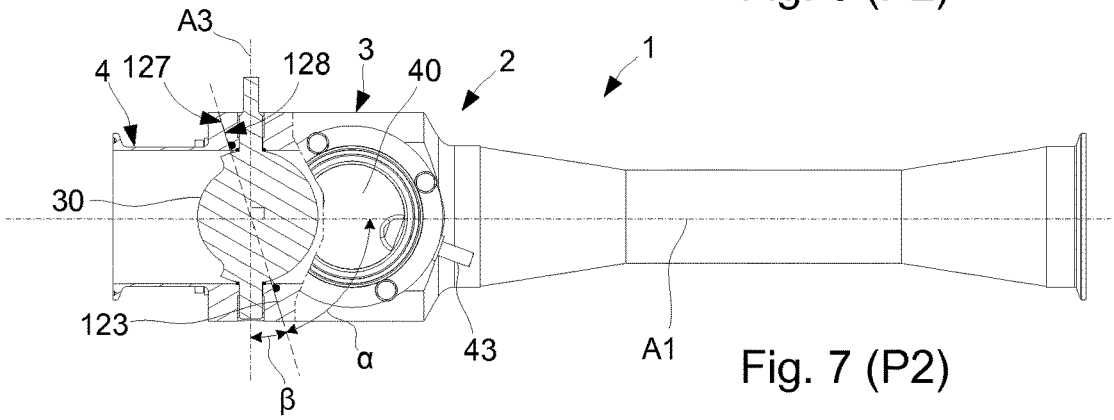
Fig. 7 (P2)

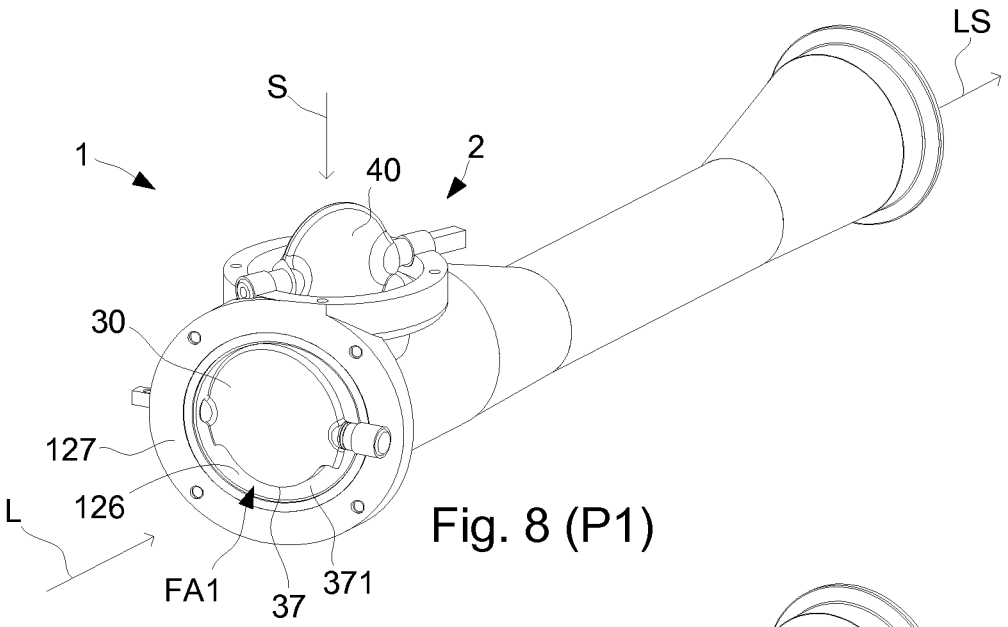
Fig. 8 (P1)
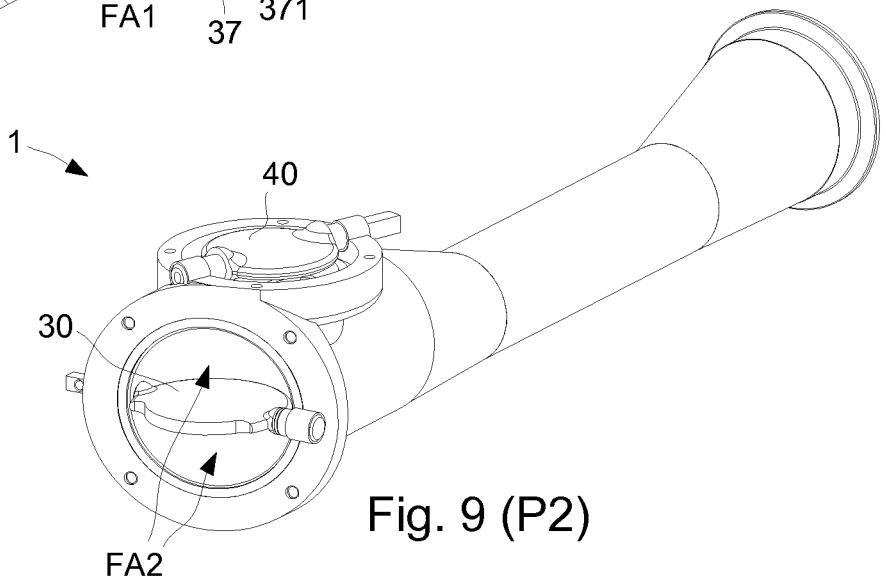
Fig. 9 (P2)
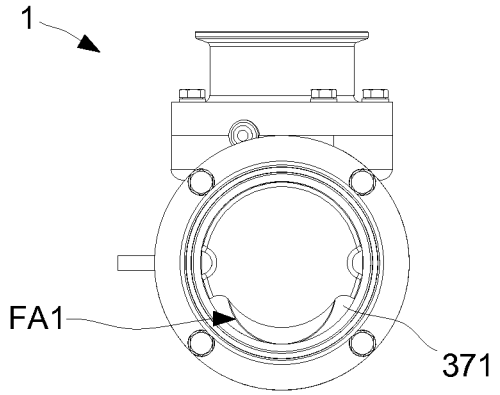
Fig. 10 (P1)
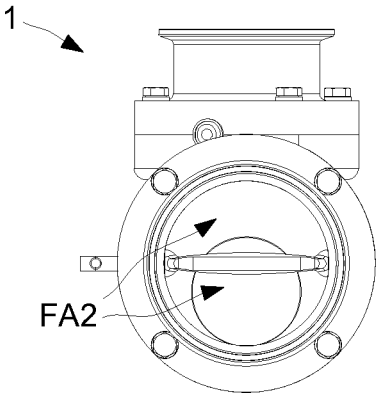
Fig. 11 (P2)

VENTURI MIXER WITH ADJUSTABLE FLOW RESTRICTOR

TECHNICAL FIELD

The invention relates to an apparatus for mixing a liquid and a substance, where a Venturi effect is created such that a flow of the liquid draws the substance into a mixing chamber.

BACKGROUND

In food industry it is in many processes common to mix a substance into a liquid. The substance may a solid, e.g. in form of a powder, or may be a liquid that is different from or even same as the liquid it shall be mixed into. Water, liquid diary products, sugar solutions are some examples of liquid into which another substance may be mixed. Examples of substances to be mixed into liquid is milk powder, additives and stabilizers in dry form, liquid food additives, food concentrates, other liquid ingredients or even the same liquid. These liquids and substances to be mixed into the liquid are just a few examples of liquids and substances that are used as ingredients for producing food. There is a huge number of liquids into which another substance, sometimes referred to as a second substance, is commonly mixed so that a food product is obtained.

One type of mixing apparatus that is used for this purpose use the Venturi effect for accomplishing the mixing. As is well known, the Venturi effect is the reduction in fluid pressure that results when a fluid flows through a constricted section of a fluid conduit. The reduction in pressure, caused by the flow of the liquid, draws the substance into the liquid. The drawing of the substance into the liquid thus effects mixing, since the liquid and the substance obviously are combined and thereafter leave the apparatus as one common liquid stream. The mixing apparatus is sometimes referred to as an injector, or as a suction device since it creates a relatively lower pressure that "sucks in" the substance into the liquid.

Some examples of prior art mixing apparatuses that use the Venturi effect are shown in patent documents U.S. Pat. Nos. 5,779,355A and 8,496,189B2. Even though these apparatuses successfully mix liquid and a substance, they fail to address hygienic requirements that must be fulfilled when used within the food processing industry. In particular, in the food processing industry it is very important that a mixing apparatus using the Venturi effect may be efficiently cleaned.

SUMMARY

It is an object of the invention to at least partly overcome one or more of the above-identified limitations of the prior art. In particular, it is an object to provide an apparatus that uses the Venturi efficiently mix a liquid and a substance, while at the same time give the apparatus a design that allows it to be efficiently cleaned so that it is usable within the food processing industry.

According to one aspect, to solve these objects an apparatus for mixing a liquid and a substance is provided. The apparatus comprises: a housing having a mixing chamber; a first inlet to the mixing chamber, for conveying the liquid into the mixing chamber; a second inlet to the mixing chamber, for conveying the substance into the mixing chamber; an outlet, for conveying a mixture of the liquid and the substance out from the mixing chamber; and a flow restrictor arranged in the housing, between the first inlet and the mixing chamber. The flow restrictor is controllable to switch between a first position providing a first through flow area configured to create a Venturi effect such that a flow of the liquid draws the substance into the mixing chamber, and a second position providing a second through flow area that is larger than the first through flow area to thereby decrease a pressure drop caused by the flow restrictor.

Having two positions for the flow restrictor is advantageous in that it allows for two operation modes, one where mixing is accomplished and one where cleaning may be accomplished. The cleaning is typically performed when the pressure drop caused by the flow restrictor is decreased in the second position (as compared to the pressure drop caused by the flow restrictor when it is in the first positon). A decreased pressure drop is advantageous in that it becomes easier to pump e.g. a cleaning liquid through the apparatus, which saves energy and makes it easier to fulfill sanitary requirements.

The flow restrictor may comprise a disk that is arranged to rotate about a geometrical axis, between the first position and the second position. This makes cleaning even easier since impact angles and turbulence for a flow of cleaning liquid may, from a cleaning perspective, become more beneficial when the flow restrictor is in the second position. In detail, in the first position the disk may be arranged at a right angle to an incoming a flow of liquid. In the second position, the disk may be arranged parallel to incoming cleaning liquid.

The flow restrictor may comprises a first protrusion that extends into a first opening in the housing, and a second protrusion that extends into a second opening in the housing, such that the housing supports the flow restrictor. One or both of the openings may be a through-opening in the hosing, or may form a hole with a bottom in the housing. The protrusions may be arranged at opposite side of the flow restrictor.

The apparatus may comprise a first ring-shaped gasket arranged around the first protrusion, at a location between the flow restrictor and the housing, and a second ring-shaped gasket arranged around the second protrusion, at a location between the flow restrictor and the housing.

The flow restrictor may comprise an engagement element that is connected to the first protrusion and extends out from the housing, such that the engagement element is connectable to an actuator.

The flow restrictor may comprise a cut-out that in combination with an inner wall of the housing forms a gap that defines the first through flow area.

In one embodiment, when the flow restrictor is in the first position, the cut-out is located opposite the second inlet, as seen in a radial direction of a main axis of the apparatus. The cut-out may be offset from the second inlet, in a direction towards the first inlet as seen in an axial direction of the main axis.

The cut-out may have an angular extension of 80° to 150° along a periphery of the flow restrictor.

The apparatus may comprise a second flow restrictor arranged in the housing between the second inlet and the mixing chamber. The second flow restrictor is then controllable to switch between an open position for allowing the substance to enter into the mixing chamber, and a closed position for closing a passage between the second inlet and the mixing chamber.

The housing may comprise a first housing part and a second housing part that are connected to each other at a respective connection surface.

The first opening into which the first protrusion of the flow restrictor extends may be arranged in the first housing part. The second opening into which the second protrusion of the flow restrictor extends may be arranged in the first housing part.

Each connection surface of the housing parts may be inclined by an angle relative the geometrical axis about which the flow restrictor is arranged to rotate.

A gasket may be arranged between the first and second housing parts, the first and second housing parts being disconnectable from each other to allow the gasket to be replaced.

At least one of the first and second housing parts may comprises a groove for accommodating the gasket.

According to another aspect a method of operating an apparatus that includes any of the features above is provided. The method comprises: mixing a liquid and a substance by supplying the liquid to the first inlet and supplying the substance to the second inlet, when the first flow restrictor is in the first position and the second flow restrictor is in the open position; and cleaning the apparatus by supplying cleaning liquid to the first inlet, when the first flow restrictor is in the second position and when the second flow restrictor is in the closed position.

Further objectives, features, aspects and advantages of the invention will appear from the following detailed description as well as from the drawings.

DRAWINGS

Embodiments of the invention will now be described, by way of example, with reference to the accompanying schematic drawings, in which FIG. 1 is a perspective view of an apparatus for mixing a liquid and a substance, as shown when set for receiving cleaning liquid, FIG. 2 is top view of the apparatus of FIG. 1, FIG. 3 is a partial front view of a fluid blocker of the apparatus of FIG. 1, FIGS. 4, 5 and 10 show a cross-sectional side view, a top view partially in cross-section, and a front view of the apparatus of FIG. 1, when the apparatus is set for mixing liquid and a substance, FIGS. 6, 7 and 11 correspond to FIGS. 4, 5 and 10, but show the apparatus when set for receiving cleaning liquid, FIGS. 8 and 9 are perspective views of one housing part of the apparatus of FIG. 1, when set for mixing liquid and a substance respectively when set for receiving cleaning liquid, FIG. 12 is a front view of gasket used in the apparatus of FIG. 1, and FIG. 13 is a flow chart of a method of operating the apparatus of FIG. 1.

DESCRIPTION

With reference to FIGS. 1 and 2 an apparatus 1 for mixing a liquid L and a substance S is illustrated. The apparatus 1 has a housing 2 with first inlet 111 that is arranged to receive the liquid L, and a second inlet 171 that is arranged to receive the substance S. The liquid L and the substance S are mixed inside the apparatus 1 into a mixture LS, which exits the apparatus 1 via an outlet 161.

The housing 2 has a first housing part 3 and a second housing part 4 that are connected to each other by bolts. Other means for connecting the housing parts 3, 4 to each other may be used, such as various clamps, threaded ring arrangements etc. The first housing part 3 and the second housing part 4 are two distinct parts that are separable from each other when the connection between them is released (e.g. when the bolts are unscrewed), and there is thus a boundary 123 where the housing parts 3, 4 meet.

With further reference to FIGS. 4 and 5 the apparatus 1 has, as seen in direction from the first inlet 111 to the outlet 161, an inlet section 11, a chamber section 12, a converging section 13, a straight section 14, a diverging section 15 and a short straight section 16. These sections 11-16 extend along a main axis A1 of the apparatus 1. The main axis A1 is centered at the first inlet 111. A solid inlet section 17 is arranged on the chamber section 12 and comprises the second inlet 171, which is centered around an axis A2 that is perpendicular to the main axis A1.

The chamber section 12 has an interior space that forms a mixing chamber 129 that extend along the main axis A1. The first inlet 111 and the second inlet 171 form inlets to the mixing chamber 129, so that the liquid L and the substance S may be conveyed into the mixing chamber 129. The outlet 161 conveys, via sections 13-16, a mixture LS of the liquid L and the substance S out from the mixing chamber 129. A flow restrictor 30 is arranged in the housing 2, at a location between the first inlet 111 and the mixing chamber 129.

With further reference to FIGS. 3 and 6-11, the flow restrictor 30 is controllable to switch between a first position P1 (FIGS. 4, 5, 8 and 10) and a second position P2 (FIGS. 6, 7, 9 and 11). When the flow restrictor 30 is in the first position P1 it provides a first through flow area FA1 that has a size and shape that creates a Venturi effect when the liquid L flows into the first inlet 111. The Venturi effect is, as is commonly known, the reduction in fluid pressure that results when a fluid flows through a constricted section of a fluid conduit. The reduced pressure draws the substance S into the mixing chamber 129.

The second position P2 of the flow restrictor 30 provides a second through flow area FA2 that is larger than the first through flow area FA1. This decreases a pressure drop caused by the flow restrictor 30, as compared to when the flow restrictor 30 is in the first position P1.

The flow restrictor 30 comprises a disk 39 that is arranged to rotate about a geometrical axis A3, which axis A3 in the illustrated embodiment is transverse the main axis A1. The disk 39 rotates between the first position P1 and the second position P2. The flow restrictor 30 has, at a respective opposite side of the disk 39, a first protrusion 31 and a second protrusion 32. The first protrusion 31 extends into a first opening 124 in the housing 2, and a second protrusion 32 extends into a second opening 125 in the housing 2, such that the housing thereby 2 supports the flow restrictor 30. In principle, the openings 124, 125 act as bearings for the flow restrictor 30. The openings 124, 125 may be through holes that extend through the housing 2. Alternatively, at least the second opening 125 may have the form of a hole with a bottom in the interior of the housing 2.

To control the flow restrictor 30 to switch between the first position P1 and the first position P1 an actuator (not shown) may be connected to an engagement element 33 that is connected to the first protrusion 31. Basically, the switching is implemented by rotating the flow restrictor 30 by 90° between the illustrated positions P1, P2. The engagement element 33 extends out from the housing 2, such that it is connectable to the actuator. Any suitable, conventional actuator may be used for the control, such as mechanical, pneumatic and electrical actuators that are either manually or automatically controlled.

The flow restrictor 30, or more particularly the disk 39, has a cut-out 37 that in combination with an inner wall 126 of the housing 2 forms a gap 371 that defines the first through flow area FA1. The cut-out 37 has an angular extension e of 80° to 150° along a periphery 38 of the flow restrictor 30. The gap 371 has a height D that corresponds to the distance from the cut-out 37 to the inner wall 126 of the housing 2. The periphery 38 of the flow restrictor 30 has a rounded surface 36, at least on the side of the disk 39 that is opposite the cut-out 37. When the flow restrictor 30 is in the first position P1, then the cut-out 37 is located opposite the second inlet 171, as seen in a radial direction D2 of the main axis A1. The cut-out 37 is then, as may be seen, offset from the second inlet 171, in a direction towards the first inlet 111 and as seen in an axial direction D1 of the main axis A1.

The flow restrictor 30 has, between the disk 39 and the first protrusion 31, a section 34 that has a larger size than the first opening 124. A corresponding section 35 is located between the disk 39 and the second protrusion 32, and has a larger size than second opening 125. The sections 34, 35 efficiently fixes the flow restrictor 30 in an axial direction of axis A3. A first ring-shaped gasket 72 is arranged around the first protrusion 31, at a location between the flow restrictor 30 and the housing 2. Specifically, the first ring-shaped gasket 72 is arranged between the section 34 and the housing 2. A second ring-shaped gasket 73 is arranged around the second protrusion 32, at a location between the flow restrictor 30 and the housing 2. The second ring-shaped gasket 73 is arranged between the section 35 and the housing 2.

As mentioned, the housing 2 has a first housing part 3 and a second housing part 4 that are connected to each other. The first housing part 3 has a connection surface 127 that faces a connection surface 128 of the second housing part 4. The connection surface 128 of the second housing part 4 is part of a flange 122 that is joined with the inlet section 11. The connection surface 127 of the first housing part 3 is part of a flange 121 that is joined with the chamber section 12.

The first opening 124 for the first protrusion 31 of the flow restrictor 30 is arranged in the first housing part 3. The second opening 125 for the second protrusion 32 of the flow restrictor 30 is arranged in the second housing part 4. The first opening 124 and second opening 125 are fully located within a respective housing part 3, 4. This is advantageous since the boundary 123 between the connection surfaces 127, 128 does not intersect any of the first opening 124 and the second opening 125. As a result sealing is made more sanitary, and the ring-shaped gaskets 72, 73 only engage a respective part of the first housing part 3 and the second housing part 4.

Each connection surface 127, 128 of the housing parts 3, 4 is inclined by an angle β relative the geometrical axis A3 about which the flow restrictor 30 is arranged to rotate. This angle β should be large enough so that the first opening 124 and second opening 125 are fully located within a respective housing part 3, 4. The angle β is typically larger than 10°. Each connection surface 127, 128 of the housing parts 3, 4 is, for the illustrated embodiment, inclined by an angle α that is smaller than 90° relative the main axis A1. The angle α is typically smaller than 80°.

At least one of the first and second housing parts 3, 4, in the illustrated example the first housing part 3, has a groove 1210 for accommodating a gasket 71. The gasket 71 is ring-shaped, as may be seen in FIG. 12, and is arranged in the groove 1210 between the first and second housing parts 3, 4. As indicated, the first and second housing parts 3, 4 are disconnectable from each other so that the gasket 71 may be replaced. Since the gasket 71 is aligned with the surfaces 127, 128, an area 715 defined by a periphery 714 of the gasket 71 is also inclined by the angle β relative the geometrical axis A3.

A second flow restrictor 40 is located in the housing 2, between the second inlet 171 and the mixing chamber 129. The second flow restrictor 40 is controllable to switch between an open position P1 for allowing the substance S to enter into the mixing chamber 129, and a closed position P2 for closing a passage between the second inlet 171 and the mixing chamber 129. The second flow restrictor 40 may be identical with the flow restrictor 30, but without having the cut-out, and has an engagement element 43 that is connectable to an actuator (not shown). This actuator may be an actuator of the same type as is used for switching flow restrictor 30. The second flow restrictor 40 may then be switched between the open position P1 and the closed position P2 by turning it 90° between the illustrated positions. A gasket 74 is arranged in the housing 2, at a location where it surrounds a periphery of the second flow restrictor 40 when the second flow restrictor 40 is in the illustrated, closed position P2.

With reference to FIG. 13 a method of operating the apparatus 1 is illustrated. When the apparatus 1 is operated it is, at the first inlet 111, connected to a liquid supply, and, at the second inlet 171, connected to a supply of substance that shall be mixed into the liquid. The outlet 161 is connect to a recipient that receives a mixture of the liquid and the substance. Any conventional supplies, recipient and connection techniques may be used for this purpose. By which flow rate the liquid shall be supplied with in order to create an optimal Venturi effect may depend on the type of liquid, and is therefore preferably empirically determined. Cleaning liquid CL (see FIG. 6) may be supplied through the apparatus 1 by using any suitable, conventional system for cleaning food processing lines that are arranged to produce liquid food.

The method comprises mixing 91 the liquid L and the substance S by supplying the liquid to the first inlet 111 and by supplying the substance S to the second inlet. The (first) flow restrictor 30 is then in the first position P1 while the second flow restrictor 40 is in the open position P1. When the mixing is done the apparatus 1 is cleaned 92 by supplying cleaning liquid to the first inlet 111. Then the (first) flow restrictor 30 is in the second position P2 while the second flow restrictor 40 is in the closed position P2. The cleaning liquid may then flow from the first inlet 111, through the apparatus 1 and to the outlet 161.

The apparatus 1 must not necessarily have a through flow area FA1 in the first position P1 that is defined by the cut-out 37 in the flow restrictor 30. Other shapes and openings that creates an area (passage) past or through the flow restrictor and which accomplish the Venturi effect may be used. For example, instead of the cut-out a through hole may be arranged in the disk 39.

From the description above follows that, although various embodiments of the invention have been described and shown, the invention is not restricted thereto, but may also be embodied in other ways within the scope of the subject-matter defined in the following claims.

The invention claimed is:

1. An apparatus for mixing a liquid and a substance, comprising:

a housing having a mixing chamber, a first inlet to the mixing chamber, for conveying the liquid into the mixing chamber, a second inlet to the mixing chamber, for conveying the substance into the mixing chamber, an outlet, for conveying a mixture of the liquid and the substance out from the mixing chamber, and a flow restrictor arranged in the housing, between the first inlet and the mixing chamber, wherein the flow restrictor is controllable to switch between a first position providing a first through flow area configured to create a Venturi effect such that a flow of the liquid draws the substance into the mixing chamber, and a second position providing a second through flow area that is larger than the first through flow area to thereby decrease a pressure drop caused by the flow restrictor, wherein the flow restrictor comprises a first protrusion that extends into a first opening in the housing, and a second protrusion that extends into a second opening in the housing, such that the housing supports the flow restrictor, the housing comprises a first housing part and a second housing part that are connected to each other at a respective connection surface, the first housing part and the second housing part being two distinct parts that are separable from one another when the connection between them is released, the first opening is arranged in a sidewall of the first housing part and the second opening is arranged in a sidewall of the second housing part, and the first protrusion is supported in the first opening in the sidewall of the first housing part and the second protrusion is supported in the second opening in the sidewall of the second housing part to thereby support the flow restrictor.

2. The apparatus according to claim 1, wherein the flow restrictor comprises a disk that is arranged to rotate about a geometrical axis, between the first position and the second position.

3. The apparatus according to claim 1, comprising:

a first ring-shaped gasket arranged around the first protrusion, at a location between the flow restrictor and the housing, and a second ring-shaped gasket arranged around the second protrusion, at a location between the flow restrictor and the housing.

4. The apparatus according to claim 1, wherein the flow restrictor comprises an engagement element that is connected to the first protrusion and extends out from the housing, such that the engagement element is connectable to an actuator.

5. The apparatus according to claim 1, wherein the flow restrictor comprises a cut-out that in combination with an inner wall of the housing forms a gap that defines the first through flow area.

6. The apparatus according to claim 5, wherein, when the flow restrictor is in the first position, the cut-out is located:

opposite the second inlet, as seen in a radial direction of a main axis of the housing, and offset from the second inlet, in a direction towards the first inlet as seen in an axial direction of the main axis.

7. The apparatus according to claim 5, wherein the cut-out has an angular extension of 80° to 150° along a periphery of the flow restrictor.

8. The apparatus according to claim 1, comprising a second flow restrictor arranged in the housing between the second inlet and the mixing chamber, the second flow restrictor being controllable to switch between:

an open position for allowing the substance to enter into the mixing chamber, and a closed position for closing a passage between the second inlet and the mixing chamber.

9. The apparatus according to claim 2, wherein the first housing part and the second housing part are connected to each other at a respective connection surface, and each connection surface of the first and second housing parts is inclined by an angle relative the geometrical axis about which the flow restrictor is arranged to rotate.

10. The apparatus according to claim 1, wherein a gasket is arranged between the first and second housing parts, the first and second housing parts being disconnectable from each other to allow the gasket to be replaced.

11. The apparatus according to claim 10, wherein at least one of the first and second housing parts comprises a groove for accommodating the gasket.

12. The apparatus of claim 1, wherein the first protrusion is rotatably mounted in the first opening in the sidewall of the first housing part and the second protrusion is rotatably mounted in the second opening in the sidewall of the second housing part to thereby permit rotation of the flow restrictor about a rotation axis that extends through the first and second openings of the housing.

13. A method of operating an apparatus for mixing liquid and a substance, the method comprising:

providing the apparatus, the apparatus comprising:

a housing having a mixing chamber, a first inlet to the mixing chamber, for conveying the liquid into the mixing chamber, a second inlet to the mixing chamber, for conveying the substance into the mixing chamber, an outlet, for conveying a mixture of the liquid and the substance out from the mixing chamber, and a flow restrictor arranged in the housing, between the first inlet and the mixing chamber, wherein the flow restrictor is controllable to switch between a first position providing a first through flow area configured to create a Venturi effect such that a flow of the liquid draws the substance into the mixing chamber, and a second position providing a second through flow area that is larger than the first through flow area to thereby decrease a pressure drop caused by the flow restrictor, wherein the flow restrictor comprises a first protrusion that extends into a first opening in the housing, and a second protrusion that extends into a second opening in the housing, such that the housing supports the flow restrictor, the housing comprises a first housing part and a second housing part that are connected to each other at a respective connection surface, the first housing part and the second housing part being two distinct parts that are separable from one another when the connection between them is released, the first opening is arranged in a sidewall of the first housing part and the second opening is arranged in a sidewall of the second housing part, and the first protrusion is supported in the first opening in the sidewall of the first housing part and the second protrusion is supported in the second opening in the sidewall of the second housing part to thereby support the flow restrictor;

mixing the liquid and the substance by supplying the liquid to the first inlet and supplying the substance to the second inlet, when the flow restrictor is in the first position and the second flow restrictor is in the open position, and cleaning the apparatus by supplying cleaning liquid to the first inlet, when the flow restrictor is in the second position and when the second flow restrictor is in the closed position.

* * * * *